US007408653B1

(12) United States Patent
LaCarrubba

(10) Patent No.: US 7,408,653 B1
(45) Date of Patent: Aug. 5, 2008

(54) SHIM DIALER PLATFORM AND PROCESS TO COMPENSATE FOR OPTICAL VARIATIONS IN COMPONENTS USED IN THE ASSEMBLY OF SEEKER HEADS WITH FOLDED OPTICS FOR SEMI-ACTIVE LASER GUIDED CANNON LAUNCHED PROJECTILES

(75) Inventor: Paul J. LaCarrubba, Hopatcong, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 236 days.

(21) Appl. No.: 11/307,222

(22) Filed: Jan. 27, 2006

(51) Int. Cl.
*G01B 11/14* (2006.01)

(52) U.S. Cl. ..... 356/614; 356/141.1; 250/252.1

(58) Field of Classification Search ..... 356/614, 356/141.1; 359/196, 172, 159; 250/252.1, 250/353
See application file for complete search history.

(56) References Cited

U.S. PATENT DOCUMENTS 3,802,784 A * 4/1974 Reynolds et al. ..... 356/432
4,341,442 A * 7/1982 Johnson ..... 385/11
4,595,833 A * 6/1986 Sting ..... 250/353
5,608,213 A * 3/1997 Pinkus et al. ..... 250/252.1
6,297,897 B1 * 10/2001 Czichy et al. ..... 398/122
6,665,063 B2 * 12/2003 Jamieson et al. ..... 356/141.1
6,832,845 B1 * 12/2004 Kretzschmar et al. ..... 362/277
7,177,057 B2 * 2/2007 Morrow et al. ..... 359/196

* cited by examiner

*Primary Examiner*—Sang Nguyen
(74) *Attorney, Agent, or Firm*—Michael Sachs

(57) ABSTRACT

A through-optical bench is the optical equivalent of a folded-optical system. Folded optics is generally found in cannon launched guided projectiles and always includes a mirror mounted on a gimbal. Inside the projectile the optical image is hidden behind the mirror and is not easily accessible by measurement instrument. In the through-optical bench the image is repositioned to where it is easily viewed; hence enabling a much finer process to improve manufacturing accuracy and throughput. The through-optical bench uses a collimated beam of light which passes through the seeker nose optical cluster, then through a mask which mimics the mirror, then through an identical optical cluster which substitutes for the reflection, and finally onto a screen to form a focused image directly viewable by a microscope. The clusters and mask simultaneously step through various yaw angles made possible by a reversing linkage that moves them as mirror images. A micrometer dial simulates the focusing shim for the particular seeker nose cluster.

14 Claims, 12 Drawing Sheets

SHIM DIALER PLATFORM AND PROCESS TO COMPENSATE FOR OPTICAL VARIATIONS IN COMPONENTS USED IN THE ASSEMBLY OF SEEKER HEADS WITH FOLDED OPTICS FOR SEMI-ACTIVE LASER GUIDED CANNON LAUNCHED PROJECTILES

FEDERAL INTEREST STATEMENT

The inventions described herein may be manufactured, used, and licensed by, or for the U.S. Government for U.S. Government purposes.

FIELD OF THE INVENTION

The present invention generally relates to optical systems used in semi-active laser guided cannon launched projectiles. These projectiles typically use a seeker head which employs a folded optical system that includes a gimbaled platform supporting a flat mirror, a lens cluster, a photo detector, and a focusing shim. The gimbaled platform is usually the rotor of a gyro, but can be servo actuated instead. More specifically, the present invention relates to an optical bench that substitutes for the projectile seeker head, enables easy comparison of optical piece parts, provides a view of the focused image, but most importantly, will predict the performance of a costly projectile at a very early stage in its manufacture. In addition to that, precise instrumentation of the seeker optics will provide data for computerized six-degree-of-freedom flight simulations, which will lead to a more accurate assessment of battlefield defense systems.

BACKGROUND OF THE INVENTION

Two kinds of semi-active laser guided air-frames have been commonly used by the military, one type is the rocket propelled missile and the other type is the howitzer projectile. Each uses a seeker head on the nose of the air-frame to collect laser radiation emitted by the target, and enable guidance. The dish reflector is well suited for the missile seeker while the lens and mirror combination is best for the projectile seeker.

The missile uses a parabolic dish reflector to track the radiation emanating from the target. The dish reflector is thin, light in weight, has a wide aperture, good focusing throughout its field-of-view and allows a compact seeker head antenna. Along with the low weight antenna comes a lighter servo or gyro to point it for tracking. A lighter missile results in greater range.

The cannon launched projectile is subject to high acceleration inside the tube, a much more severe environment than the missile. The thin reflector is not compatible with the high shock resistance required during cannon launch and so it must be stiffened. Nose-heavy means flight stability for a projectile; but the heavier reflector, together with the additional weight of the accompanying servo, translates either into a significant penalty in range, or a significant loss in tracking response needed to follow the radiation.

One of the proposed solutions for the cannon launched projectile has been folded optics. Folded optics affords wide aperture throughout its field-of-view, the shock resistance of a strap-down optical cluster, and a light weight gyro agile enough to track easily. Its reflecting system only works with a flat mirror which is usually polished on the face of the gyro rotor. This is acceptable from a fabrication point of view because making the flat micro surface is an old technology. That said, the folded system is notorious for two troublesome characteristics. One is that the focused image morphs or changes shape as the gyro tracks in pitch or yaw. Focusing this system requires checking its focus throughout its gimbal range. This leads to the second quirk. The image is not plainly visible. These two peculiarities add uncertainty to guidance parameters like gain and feedback and this uncertainty is generally considered a drawback to folded optics. The unpredictability in optical feedback discredits computer flight simulations. The only way to be sure of the projectile's value is the costly way; to build a few and fire them. However, control over optical feedback will make this trait an asset instead of a liability, will bring a substantial improvement to performance and uniformity from one projectile to the next, and will reduce an expensive risk.

Guidance systems that track with a gimbaled antenna in the nose and try to keep a bead on the target have historically been known as using proportional navigation. The mirror is always facing the radiation, even when the missile body turns away from it, and that is the orientation of most concern. The focused spot of light must be centered on a screen in order to indicate when the antenna is on track. Missile body motion can disturb that setting. Optical feedback appears as a second order term in a folded system's transfer function, but this peculiarity is not necessarily bad. It can either enhance or degrade flight stability in a cross-wind or sudden jump in the direction of laser radiation; conditions that typically occur on the battlefield. If feedback has a positive value, then the path of the projectile will spiral away from the target; and that's bad. If it is negative then the projectile will recover from the perturbation and continue to pursue the target; and that's good. This is the reason why precise focusing of the optics is so critical.

Plastic lenses made of polycarbonate are both compact and shock resistant when incorporated into a folded optical system. However the optical characteristics of the plastic lens is sensitive to process variations of molding and annealing, resulting in significant variations in optical characteristics from one lens to another. The lens of most concern is the large plastic objective lens behind the transparent windshield where laser radiation enters. Adjustments must be made for focus for each individual seeker head, because focus, flare and other characteristics are unique to each lens. Quality cannot be held to rigid dimensions or process certification. Each seeker must be focused individually, as the lenses are not interchangeable. This leads to a serious problem.

The focused image in a folded optical seeker head is not plainly visible because it is hidden behind the mirror. This is worth repeating and cannot be over emphasized. The image of the target inside a folded seeker cannot be viewed directly. It cannot be focused by viewing an image and turning a knob, as is the case of a microscope or pair of binoculars. A folded optical seeker is so compact that there is just no way to see inside of it without extraordinary modifications to the system.

Prior to the advent of the present invention, there was no other alternative to focusing each seeker except by indirect means. Focusing done electronically through the output from the photo detector was a long and tedious process requiring skilled technicians, sophisticated equipment, hours of time, and cool precise concentration. The manufacturing record of these systems is speckled with unanticipated delays, loss of schedule and uncontrollable costs. At this writing there is still a need for a measurement system and a method to aid the focusing of seeker heads used in cannon launched projectiles. To date this need has not been satisfied.

SUMMARY OF THE INVENTION

The present invention satisfies this need, and overcomes the primary manufacturing obstacle for cannon launched laser guided projectiles that use folded optics with a flat mirror. The apparatus or mechanism comprising the present invention is referred to herein as the Shim Dialer. The original seeker head for which it was designed to control is referred to as the "folded seeker" or the "tactical seeker". Dimensions taken from the tactical seeker assembly configuration are referred to as the "nominal." The present invention provides a measurement instrument to view a focused image inside a projectile seeker equipped with a lens cluster, a photo detector, a gimbaled flat mirror, and a focusing shim. The present invention is not flyable but is well suited for a table top or assembly line.

The Shim Dialer will replicate an optical tracking system and indicate a focusing shim offset by viewing an image and turning a dial.

An object of this invention is to disclose an optical bench design which is optically equivalent to the folded seeker that employs a flat mirror, and can substitute for, mimic, imitate or simulate the folded seeker in a research, developmental or production environment.

An object of this invention is to disclose an optical bench design which makes plainly visible the image of the target on the photodetector of a folded seeker head, and enables taking measurements and photographs of it.

An object of this invention is to disclose an optical bench design which can view, measure and photograph the focused image of a folded seeker while easily swapping into the apparatus the individual optical component piece-parts, thus quickly isolating the effects of each component on tactical seeker head performance.

Another object of this invention is to disclose a method to select and match components for tactical seeker heads in mass production.

BRIEF DESCRIPTION OF THE DRAWINGS

The various features of the present invention and the manner of attaining them will be described in greater detail with reference to the following description, claims, and drawings, wherein reference numerals are reused, where appropriate, to indicate a correspondence between the referenced items, and wherein:

DETAILED DESCRIPTION OF THE PREFERRED EMBODIMENT

The Apparatus

For the purpose of illustration of the present invention, the seeker from a type-classified tactically deployed semi-active laser guided howitzer projectile is used; but in general the present invention can also be used to view and adjust the focal image of any folded optical seeker that uses a flat mirror.

Figure 1:
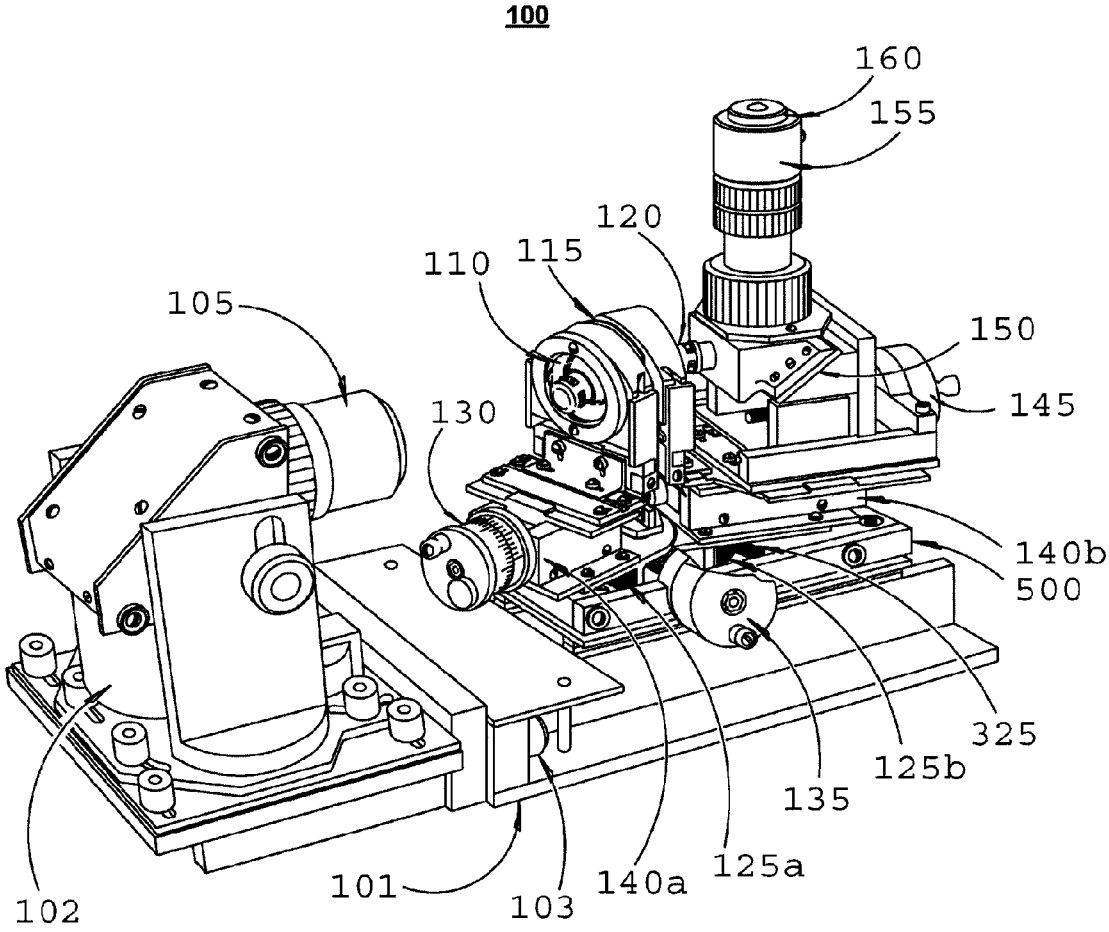
FIG. 1 represents an optical apparatus or optical bench herein called the Shim Dialer with a light source, collimator, a micrometer shim dial, a primary lens cluster, a mask, a secondary lens cluster, a dovetail way that breaks into two segments, a universal slip joint (not shown), two rollers or clevises, a micrometer yaw barrel and a microscope stage with its own focusing barrel.
Figure 2:
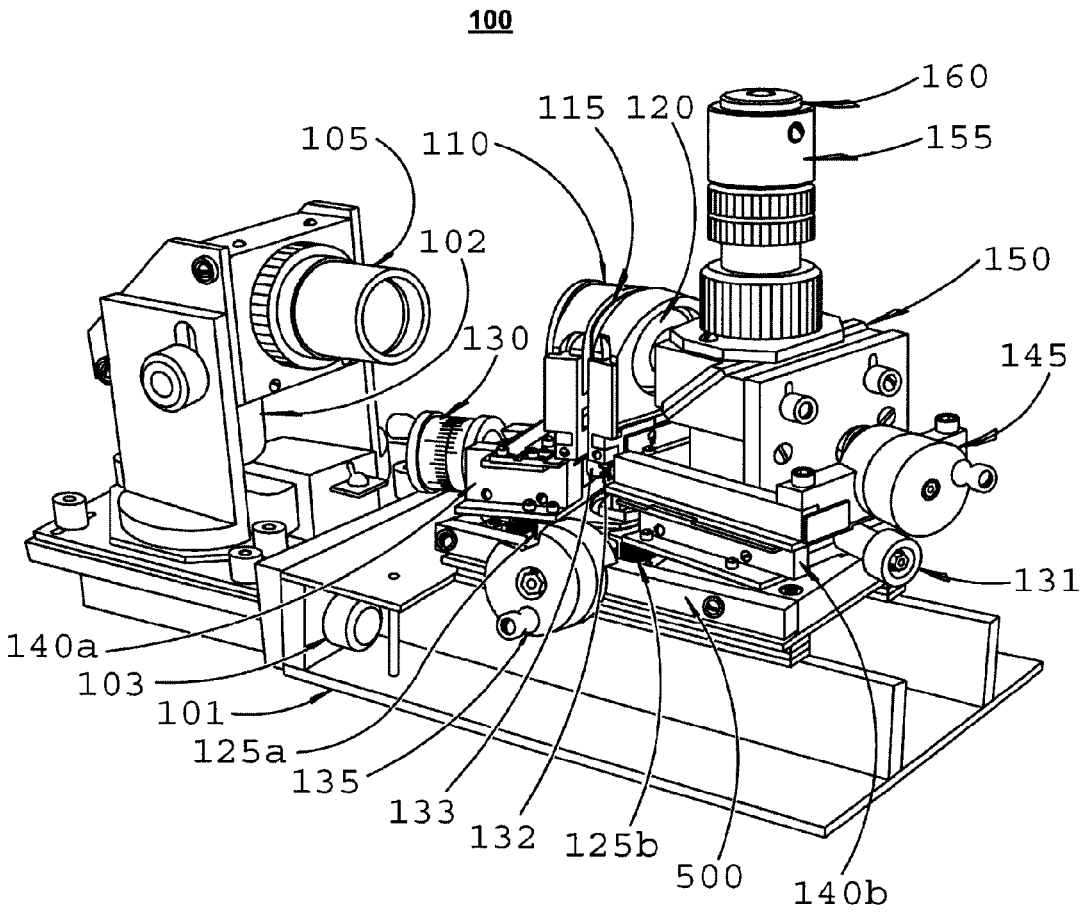
FIG. 2 represents a different perspective of the optical bench called the Shim Dialer of FIG. 1, further showing a universal joint with slip joints, and a knob to drive the dovetail way.

FIG. 1 represents the complete assembly of the present invention, the Shim Dialer, together with its accompanying collimator. Specifically, the optical system 100 is called a Shim Dialer and Collimator and consists of a rigid mounting base 101 with the collimator and dialer components mounted on it. The accompanying collimator includes, a collimator base attached to mounting base 101, a light source 102, and a collimator lens 105 adjacent to the light source. On the other side of FIG. 1 is the mounting base 101 itself, which supports the individual dialer components. The complete Shim Dialer consists of its base 101, a primary optical cluster 110, a mask 115, a secondary optical cluster 120, a reversing linkage transmission 500 showing splines 325, a pair of roller devises 125*a* and 125*b* showing splines, a shim dial 130, a yaw barrel 135, a primary dovetail way 140*a* driven by the shim dial 130, a secondary dovetail way 140*b* driven by a universal joint 132 which has a slip joint 133 at each end shown in FIG. 2, a microscope diagonal mirror housed inside slab 150, a housing for the reticule 155, a diopter adjusting microscope eyepiece 160, and a microscope focusing barrel 145. As shown in FIGS. 1 and 2, the dovetail ways are canted at about ten degrees yaw relative to the incoming beam.

The yaw barrel 135 has been cut away in FIG. 1 and FIG. 2 to make the roller splines on the devises 125 visible. Both figures show one of two knob screws 103 by base 101 that rigidly attaches the collimator section to the dialer section, allowing the option of separating them. The two sections should reassemble to a unique relative position as they index through pins and shoulders. The mask 115 is an opaque screen which has a circular aperture cut through it that coincides with the finite boundaries of the gyro mirror in the tactical seeker. The two halves of the dovetail way 140 are each mounted on one of two devises of the reversing linkage 500. The devises are constrained to rotate in opposite directions, in the same sense as the reflection of a rotating object would turn as seen in a mirror. The lead screw in the primary way is right-handed, while the screw in the secondary way is left-handed. Both screws have the same lead, an integer number of threads per unit division just like a micrometer. The two screws are connected by a combination universal and slip joint. Turning the shim dial 130 moves the two way platforms in opposite directions, again in the same sense as the reflection of a translating object would move as seen in a mirror. Specifically, clockwise rotation of the dial causes the way platforms to recede from each other, each moving away from the other by equal distances. A knob on the screw of the secondary way 131 drives the secondary way slide and also becomes an optional way of turning the dial 130 when the entire Shim Dialer is fully assembled.

The shim dial barrel 130 is engraved with numbered divisions to indicate the position of the way slide platforms on the dovetail way. The barrel includes a vernier scale. A small zero set knob on the end of the barrel, opposite the crank handle visible in FIG. 1, locks the barrel scale to allow any arbitrary way slide position to coincide with any dial reading; that is, any position of the ways can be initialized to zero or any other value.

The optical bench 100 is set up in such a way that light initially travels horizontally through the optical clusters, through the microscope objective, and then is deflected vertically upward by a diagonal mirror to have its image focused on the reticule which is viewed by the eyepiece. The splitting of folded optics into two optical clusters 110 and 120 speeds shim selection by enabling accessibility and rapid changing of the two lenses 915 and 920.

In addition to the moving parts on the Shim Dialer, there are also cross-plates visible in FIG. 1 and FIG. 2. They are grooved with interlocking rectangular slots and rail protrusions to enable independent translation of the clusters in three directions to fixed positions relative to the dovetail way sliding platforms. Specifically, the dovetail way slides are milled to interlock with the cross plates. A stack of cross plates over each way fixes the cluster mounts on three translational axes. In each case of independent translation, set screws lock the cluster mounts to fixed positions. These elongated slots and protrusions on the cross plates also function as gauging surfaces indicating perpendicularity and parallelism to the dovetail ways. In contrast however, each way itself cannot be shifted on its clevis but is rigidly indexed to the clevis in a unique position through grooves and pins on surface 330.

Each optical cluster 110 and 120 is fitted into a cluster mount shown in FIG. 1 and FIG. 2. The cluster mounts themselves have circular cavities to receive the lens clusters, as well as shoulders to seat the large lens 915. These shoulders coincide with the same shoulders on the tactical seeker. If the large lens is molded with threads, as it typically is, then the cluster mounts should be threaded as well. That will ensure easy swapping of lens samples and consistent shouldering to the nominal configuration.

Gauging fixtures must be provided which complement the Shim Dialer apparatus. The lens shoulder is a significant datum target in the assembly of the tactical seeker. A pair of gage plugs are cut to become otherwise replicas of the molded lens 915, except they include some additional features which become surfaces of contact for instruments. The plugs are threaded and shouldered just like the molded lenses and slide or screw snugly inside the cluster mounts, just as the molded parts do. These plugs lack the optical curvatures of the lenses but have flat faces instead. The flats extend a little beyond the faces of the mounts and are parallel to the lens shoulders. The plugs also have pins or probes that protrude out an equal distance beyond the planes of the lens shoulders along center lines. Thus the gage plugs align themselves to a critical feature, the lens shoulder.

Each cluster mount can also be tilted up and down independently on horizontal axes that are at right angles to the ways. The cluster mounts are pivoted on collinear bosses in their yolks so that set screws clamp them at fixed angles of elevation relative to the dovetail ways.

The collimator 105 can also be tilted to fixed positions along horizontal and vertical axes, and can translate to fixed positions vertically and horizontally at right angles relative to the path of the light 902.

The shim dialer is first assembled with crude alignment. The universal joint 132 is inserted on the lead screws of the way platforms and indexed on each keyway with a slip joint 133 such that the clusters are equally distant from the trolley nut 450 or mask 115, at least within one or two threads. A constant velocity universal joint with two journals is preferred over a simple single journal because the midshaft provides smooth turning of the shim dial and insures more accurate dial indications. The splines 325 in the reversing linkage are also meshed so that zero degree yaw barrel 135 will center the devises 125 evenly within the rack 510, as implied by FIG. 5.

Figure 3:
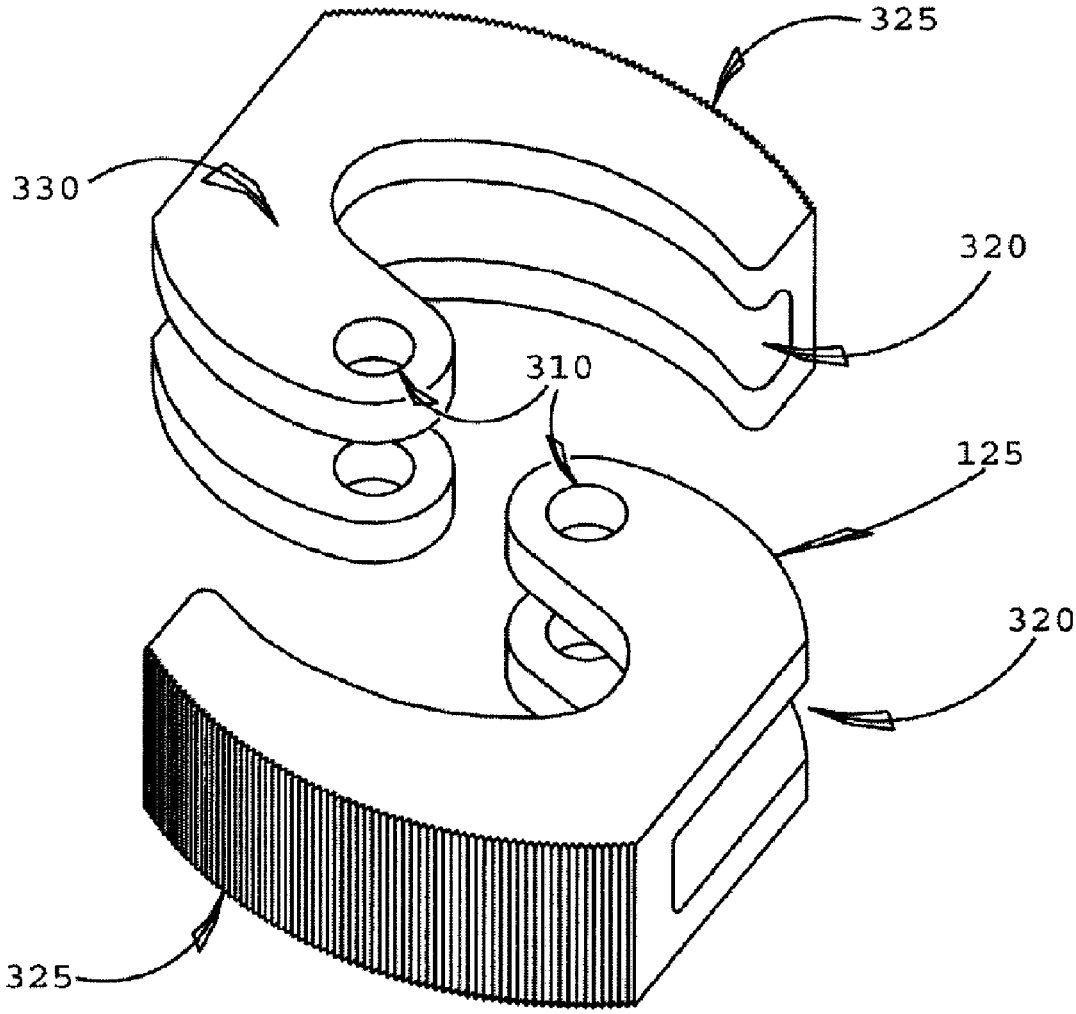
FIG. 3 represents an isometric view of a pair of devises that forms part of the present system.

FIG. 3 shows the two rotating components 125 of the reversing transmission 500. Both are identical; really sector gears which might have been cut with involute teeth but milled with splines 325 instead. Unlike gear teeth, the splines allow smooth rolling without gear tooth ripple or backlash, but like gears are constrained by their meshing. The rollers are hollow like ordinary split clevises, and each eyelet 310 is bored on the same collinear axis as the cylindrically splined face 325 or pitch circle. The faces 330 are parallel to each other and are normal to the cylindrical face. The parts shown are perfectly functional but there might be difficulty in hogging out the cavity 320. It is probably more practical to assemble the devises 125 out of separate interconnecting pieces.

Figure 4:
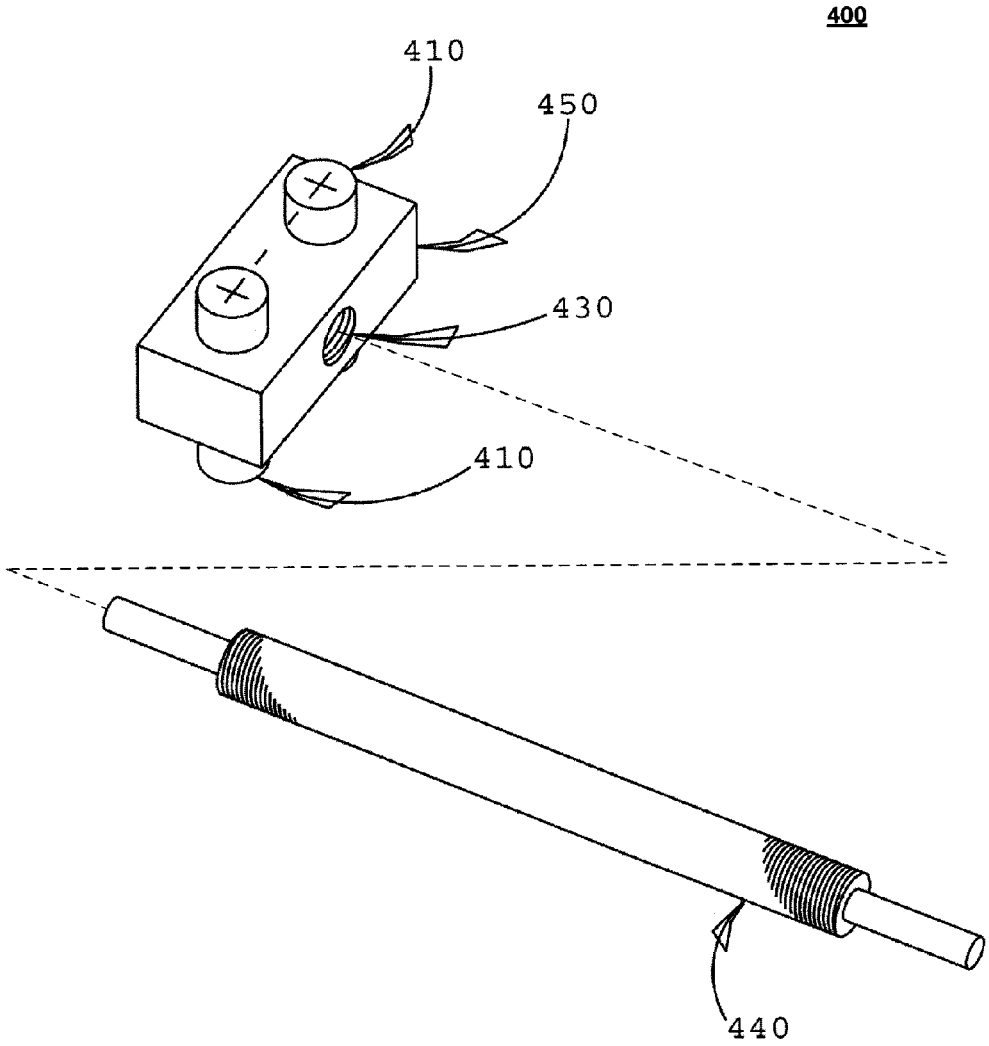
FIG. 4 represents an internally threaded block with four aligned bosses and a screw in support of the pair of devises in FIG. 3.

FIG. 4 shows the next two components of the reversing transmission 500. The screw 440 with thrust bearing ends is threaded with an integer number of threads per unit division just like a micrometer and occupies the mid-section recesses 320 of the clevises. The nut 450 has a threaded hole which has a sliding fit with the screw. Two parallel shafts which may be integral to the nut appear as four bosses 410 that stick out of it. Each pair of collinear bosses 410 protruding on both sides of the block 450 function as a pivotal or rotational center of each clevis 125. The screw hole 430 is exactly mid way between the axes of the two bosses or pins. A line connects the pins, shown in the figure, and is also referred to as 520 in FIG. 5. This line, and the thread axis, and the collinear bosses are all mutually perpendicular. Finally, the distance between the axes of the pins is exactly double the distance from the gimbal center to the surface of the mirror of the tactical seeker; that is, twice the distance between the mirror surface 925 and the intersection of trunnion axes 940 in FIG. 9 or FIG. 10. The pins 410 are mirror images of each other, but with one refinement. In this case, the object is behind the mirror and the image is in front of the mirror. The gimbal center is behind the polished surface, not in front of it. This explains the peculiar "C" shape of the devises and why they must wrap around each other as shown in FIG. 5.

Figure 5:
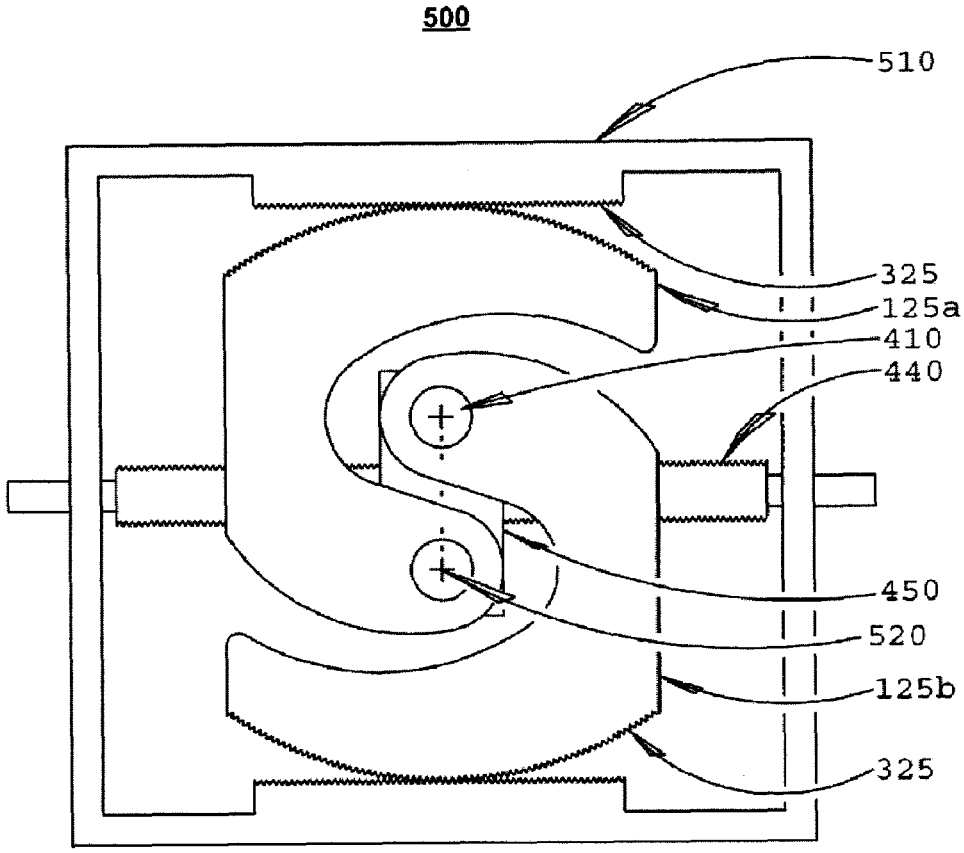
FIG. 5 represents a transmission that functions as a reversing linkage and uses a nut that trolleys on a threaded shaft, a pair of devises constrained by bosses on the nut and planar rack faces, all to replicate yaw action.

FIG. 5 shows the four components of the reversing transmission 500 listed in FIG. 3 and FIG. 4 assembled into a rack frame 510. One pair of collinear bosses 410 fit through the holes 310 on a first clevis 125*a*, and a second pair of collinear bosses 410 are pinned through the holes 310 on a second clevis 125*b*. The frame 510 constrains the threaded screw 440 on its thrust and pivotal bearings. The screw bearings have a snug but sliding fit, though FIG. 5 shows a space at the end of the threaded section, only to distinguish the screw from the frame. The screw 440 constrains the threaded nut 450. The threaded nut 450 constrains the clevises 125 on their eyelets. The clevis splines constrain or are constrained by the frame 510 by meshing with its piano rack splines 325. The line 520 joining the two eyelets on the devises is always at a right angle to the slide-fit screw threads and block 450 cannot rotate on an axis normal to the plane of the drawing.

Clearly visible in FIG. 1 and FIG. 2 and just underneath transmission 500 is a base plate supporting the entire frame which further constrains the clevis surfaces 330 and prevents them from moving out of the plane of the drawing or rotating on an axis in the plane of the drawing. The bosses on the nut protrude slightly above the surface 330 of the devises and a horizontal plate or trolley is bolted on them. Visible as an inverted "T" in FIG. 1 and FIG. 2 is one end of the horizontal trolley plate with a vertical plate on top of it. It is just above screw 440 emanating from the yaw barrel 135 in FIG. 1. The two trolley bolts, not shown, go through two holes in the trolley plate, through the two holes along the centers of both bosses of the reversing linkage nut, through two slotted holes in the base plate of the rack frame, and both are secured below through two holes in a single washer plate, two Belleville washers, and two nuts. The slotted holes in the base plate follow the path of the bosses 410, allow the nut 450 to travel along the screw 440, but keep the devises confined to a plane. The assembly can only move with one degree of freedom, and simulates the reversing action of a reflection. The plane of reflection, or mirror plane, is normal to the figure and includes the axis of the threaded screw 440.

A line is scribed on the trolley plate joining the two bolt holes, and is parallel to and directly above line 520. It is used to center the mask 115. Specifically, a block, referred to herein as a "mask block" or "bridge", is bolted on top of the trolley into a rigid indexed position. One vertical face of the mask block indexes directly over internal thread axis 430 in the transmission nut, and dissects line 520. The mask block has two horizontally threaded holes in its vertical face to affix the mask plate. The corresponding holes in the mask are a little oversized for the accompanying screws. The plane of the mask will automatically include the axis of the threaded shaft 440 and the center axis of the mask aperture will automatically be parallel to line 520. Screws and washers allow the mask axis to be adjusted directly above line 520, and elevated to the optical axes of the cluster mounts. One more thing; interference occurs because the mask block on the trolley occupies the same space as the universal joint 132. To allow passage of the joint through the mask block, a cavity is cut away from the bottom of it so that it resembles a bridge. Visible as an inverted "T" in FIG. 1 and FIG. 2 is one side of the trolley and bridge assembly.

Two micrometer barrels 135 each, indicating yaw angle, are keyed to each end of the threaded screw 440, and provide one degree of yaw per turn. The screw has a single thread. If R is the pitch circle radius of face 325 on the clevis roller 125, then the thread lead equals (2×PI×R)/360. As a rule of thumb, make R twice the focal length of the large lens 915. Then round off the lead to a standard thread size. As an example for the apparatus shown, the focal length was 1.25 inch, making R about 2.5 inch and making the lead 0.0436. That seems to be close to twenty threads per inch, as is a common ½×20 UNF or SAE bolt. Solving for R using this standard thread size, calculate (0.05×360)/(2×PI), or R=2.866 inch. The splines 325 constrain angle to displacement and so making the spline spacing the same as the thread spacing allows the splines to become an angular indicator, though this refinement is not essential.

Figure 6:
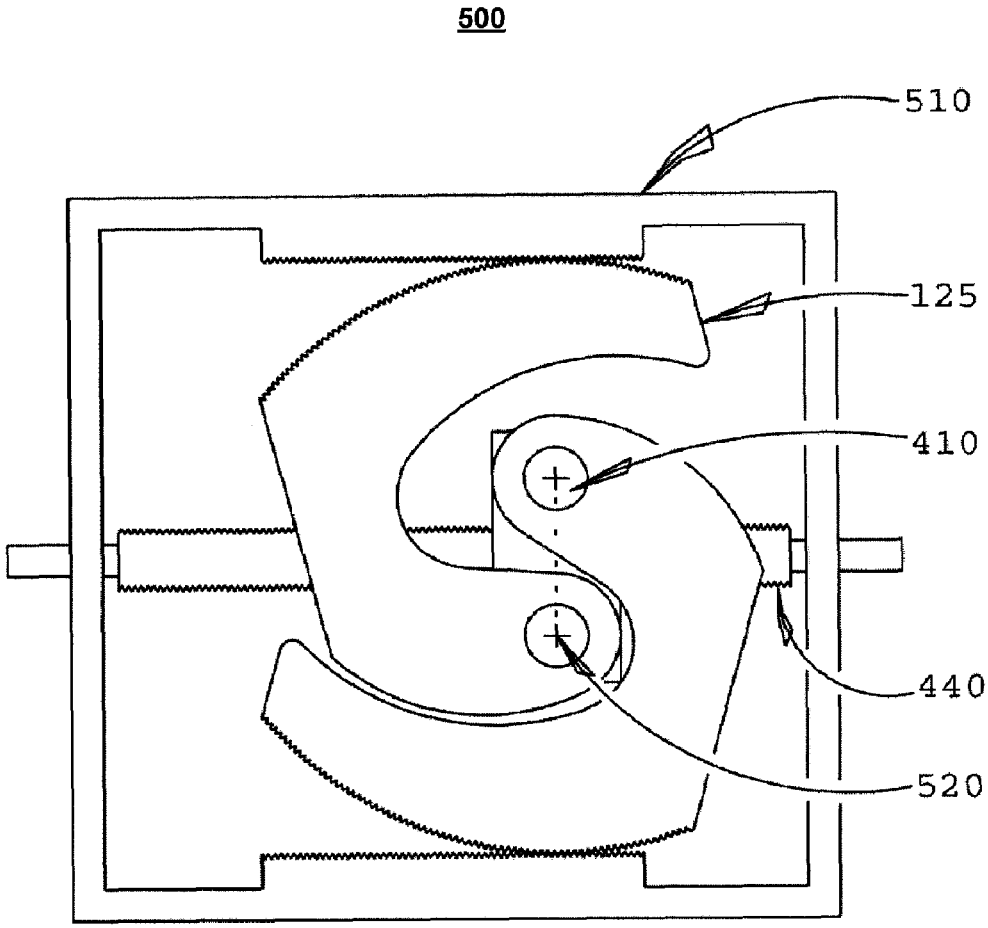
FIG. 6 represents the reversing linkage with the pair of devises rotated 10 degrees away from the zero yaw angle position of FIG. 5.

FIG. 6 represents the transmission rack 500 with the pair of devises 125 rotated from the zero yaw angle position of FIG. 5. The clevis connection line 520, shown in dotted line, is translated to the right along the axis of the threaded shaft 440. The splines 325 on the pair of devises and on the planar surfaces of the rack 510 remain in contact. Thread pitching contact and spline meshing contact constrain clevis yaw angle to clevis displacement. In summary, the rack 510 is constructed with a line of symmetry along the axis of the assembled threaded shaft, resulting in symmetrical angular and linear movements of each of the pair of clevis 125 in the transmission rack system 500. The devises can roll plus or minus fifteen degrees; which has been found to be an adequate range for tactical folded seekers. Cutting more slender "C" shaped devises may be necessary to reach a wider angular field-of-view range for a particular tactical seeker of interest.

Figure 7:
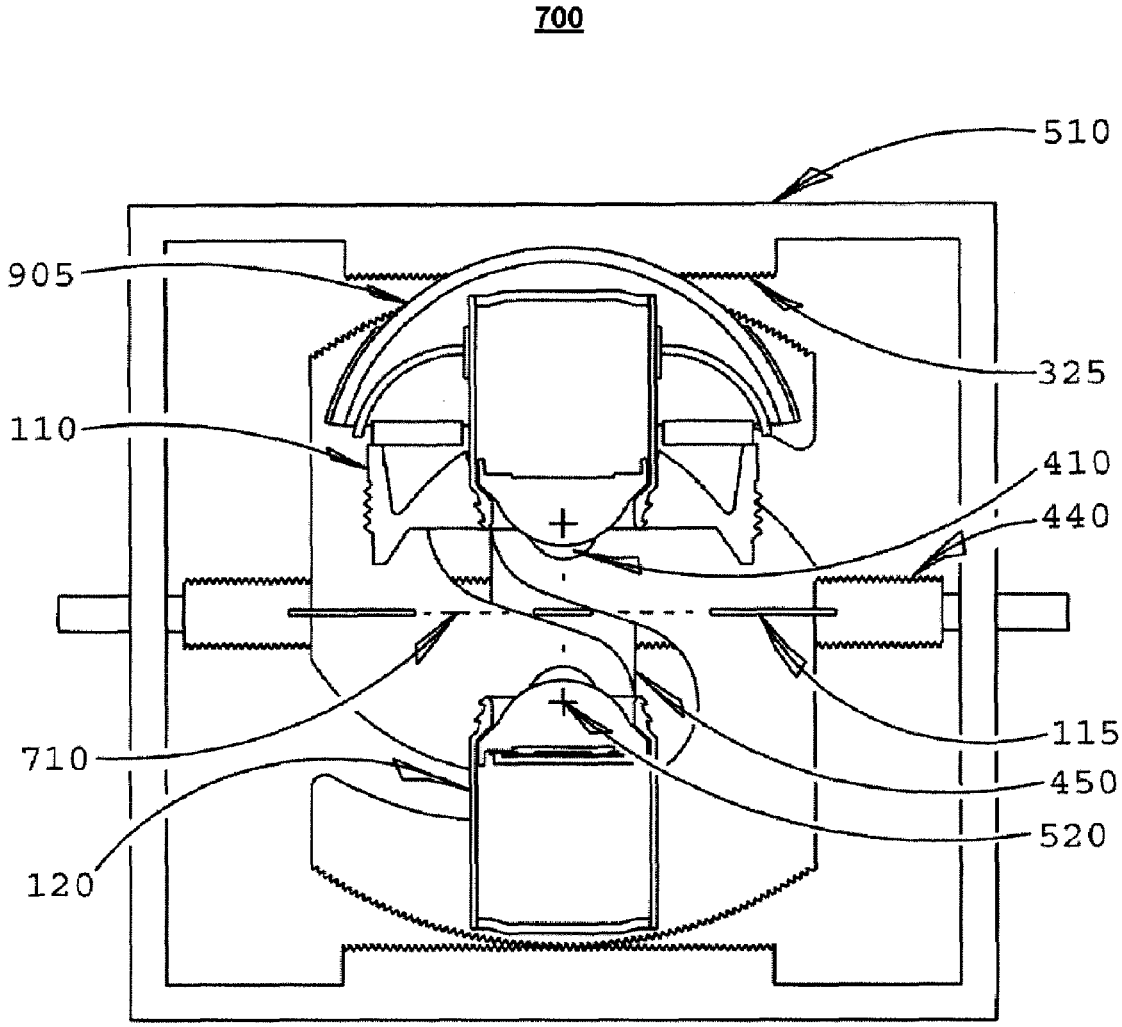
FIG. 7 represents the reversing linkage with a primary optical cluster mounted on a first clevis, and a secondary optical cluster mounted on a second clevis of the system in FIG. 5.

FIG. 7 represents the transmission rack system 700 with a primary optical cluster 110 mounted on a first clevis 125*a*, and a secondary optical cluster 120 mounted on a second clevis 125*b* of the transmission rack system 500 of FIG. 5. The primary optical cluster 110 is shown to be fitted with a windshield 905 from a projectile through which an incoming beam would pass. In addition, a mask 115 with aperture 710 is mounted midway between the opposing primary and secondary optical clusters 110 and 120. The optical axes of both clusters are in the same vertical plane of the drawing as the axes of the clevis pins 520. The clusters and mask are cut away or sectioned and the mask 115 is shown in three pieces. The mask is an opaque screen which has an aperture cut through it that coincides with the finite boundaries of the gyro mirror in the tactical seeker. A button is supported in the middle of the aperture by fine wires. It coincides with an opaque spot on the polished rotor surface for a fastener.

The mask is not attached to any clevis but rides with the nut bosses 410, as described above for FIG. 5. Specifically, a bracket in the shape of a bridge or an inverted "U", is bolted onto the trolley plate and supports the mask 115 at exactly midway between the bosses. The clearance under the bridge allows the universal joint to pass through. The segment of the mask at the center of the assembly is referred to as the button, and represents an opaque spot face at the center of the polished rotor of the tactical seeker. The button travels with the nut, is always directly over line 520, and is always midway between the reflections of the gimbal center at the ends of line 520.

Figure 8:
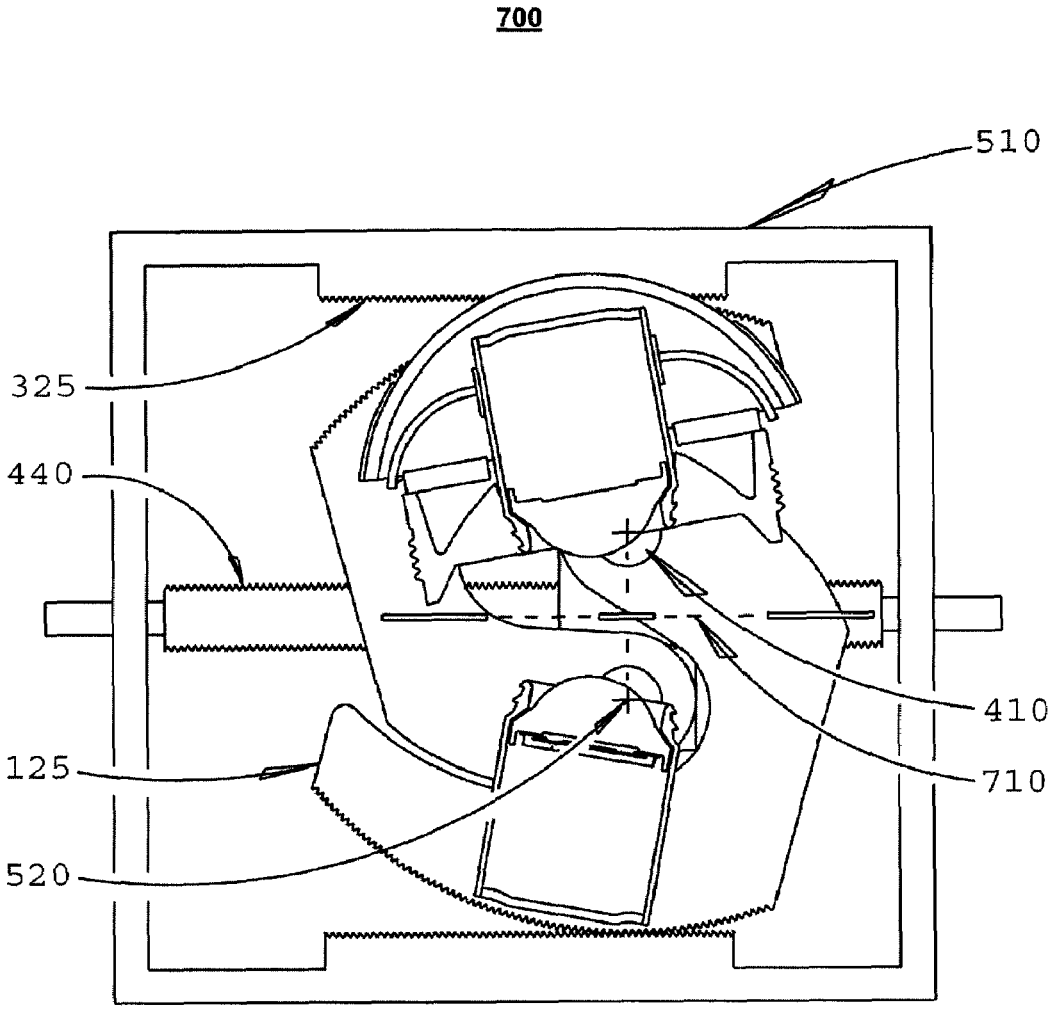
FIG. 8 represents the same rotation of the reversing linkage as shown in FIG. 6.

FIG. 8 represents a rotation of the optical transmission rack system 700 shown in FIG. 7. As the yaw barrel 135 turns the threaded shaft 440 to induce the block 450 to translate, the pair of clevis 125 are also induced to rotate and translate under the constraint of the reversing transmission rack system 500. The primary optical cluster 110 mounted on the first clevis and the secondary optical cluster 120 mounted on the second clevis also rotate and translate, following the motion of the pair of clevises. The yaw position FIG. 8 shows how the button has moved out of alignment with the optical cluster axes. It also shows that the two cluster are now slightly closer together, which explains the need for two slip joints 133 on both ends of the universal joint 132. Notice that the clusters do not wander very far from the center of the collimator beam, a desirable feature as the lamp's parallelism degrades near the edges. The discussion of FIG. 11 will explain why the large piano convex lens is not shown in the secondary clusters of FIG. 7 and FIG. 8. However, a complete pair of clusters and a rigid mask surface, or button, is useful to align the apparatus prior to using it, as will be discussed later in the procedure for using the Shim Dialer.

Figure 9:
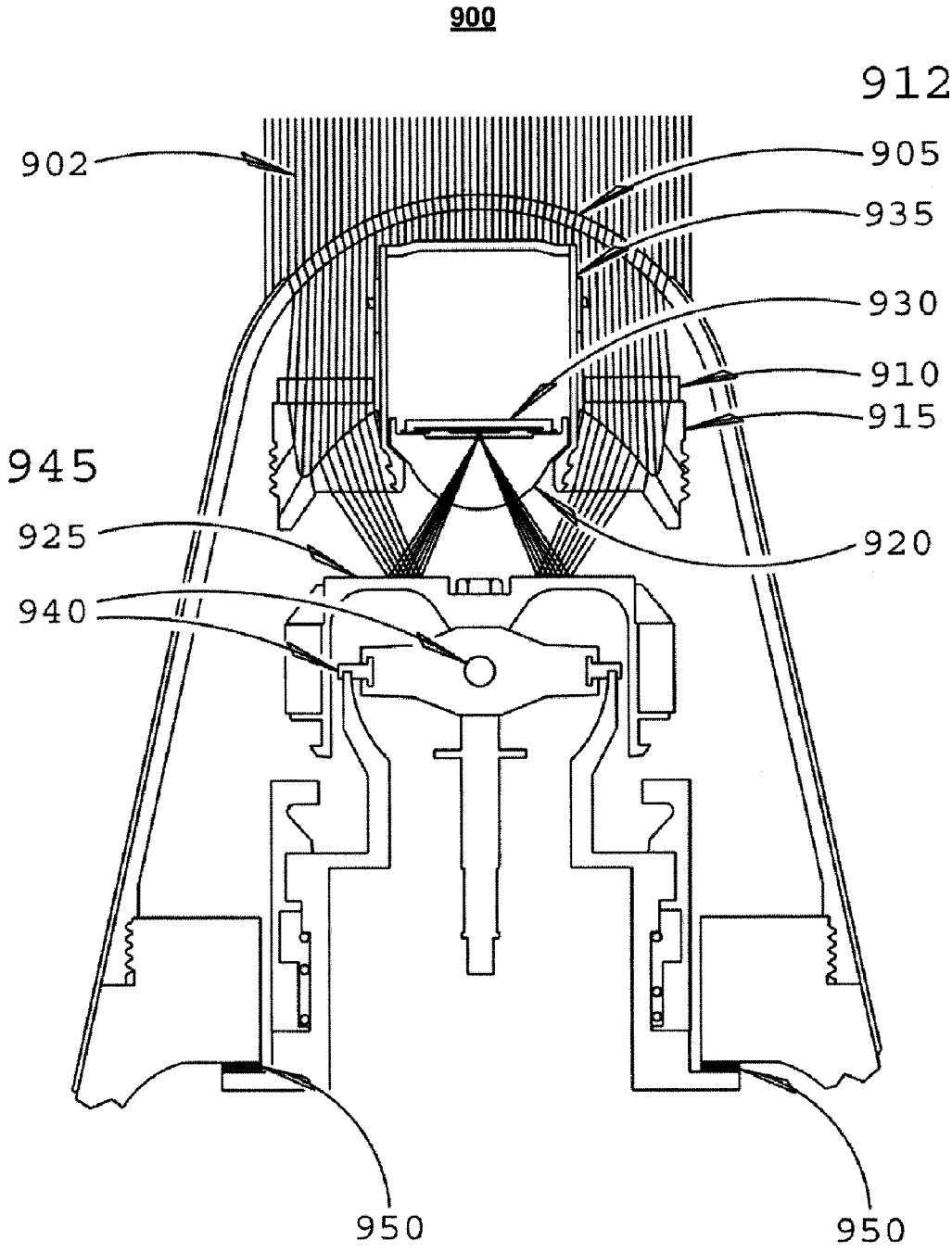
FIG. 9 represents the ray trace of a common laser tracking seeker head with a lens cluster, a gimbaled gyro rotor polished like a mirror, and a focusing shim.
Figure 10:
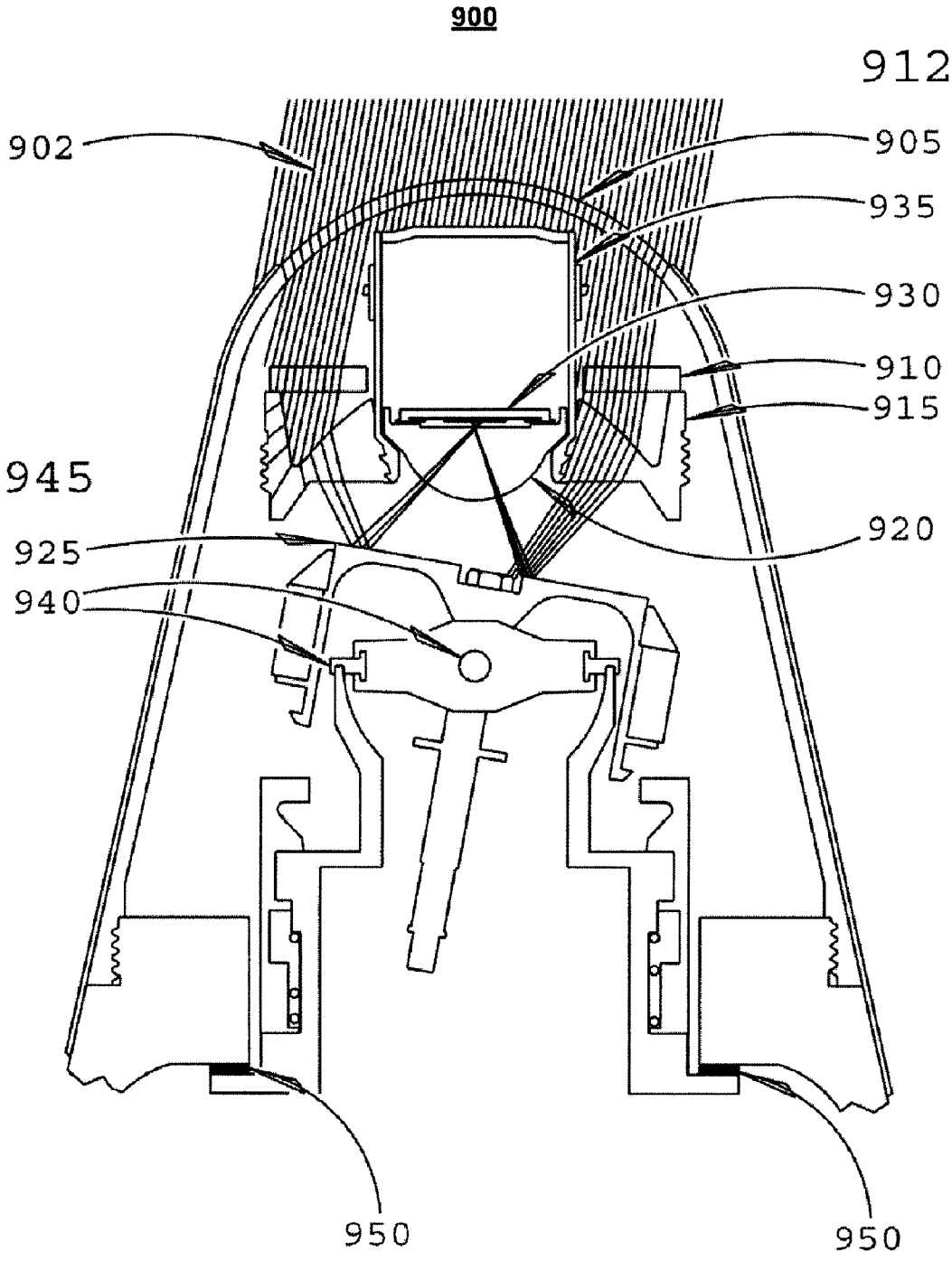
FIG. 10 represents the ray trace of the seeker when tracking radiation that is incident 10 degrees in yaw angle.

FIG. 9 and FIG. 10 are ray-traces showing the normal operation of the tactical seeker at zero and ten degrees yaw, respectively. Guidance systems that try to keep a bead on the target with a gimbaled antenna in the nose have historically been known as proportional navigation. The mirror is always facing the radiation, even when the missile body turns away from it; and it is this off-axis orientation which is of most concern. Light 902 either from a target that is far away or from a collimator that is on the inspection table passes through the single optical cluster assembly 912. The first time it enters it passes sequentially through the windshield 905, around the detector housing 935, through the clear filter glass 910, through the large piano convex lens 915 and is then reflected back by the gimbaled reflector 925 of gyro system 945. The second time the same light enters the cluster is through the small piano convex lens 920 where it is focused on the detector 930. These figures can explain why a substitute optical bench is necessary to focus the tactical seeker.

The image on the photo detector is inaccessible by any measurement equipment, as proven by the following thought exercise. The detector only has four quadrants designed to output pitch and yaw signals and cannot provide a clear video image of the focused spot. Any attempt to view the face of the detector through the gyro shaft would require an eyepiece small enough to fit through the rotor spot face and pivot inside the gimbal center, and would not provide an adequate view throughout the gimbaling range. Any attempt at temporarily replacing the detector with a translucent screen and viewing the spot image from inside the detector housing would require a diagonal mirror through the side of the housing or a hole in the collimator, and that would require blocking some of the incoming light. Possibly, either a miniature television camera, or pixeled silicon screen, or fiber-optic borescope can be temporarily fastened inside the detector housing with wires or optical filament bundles laced to the housing supporting tubes. That might be feasible, but manufacturing prefers that the detector be bonded into the housing well before the mirror and gimbaling are added to insure hardening from gun launch. We must reluctantly conclude that no independent means to directly view the image inside the tactical seeker for the purpose of optical alignment has been found at this writing.

One other drawback can be mentioned about shimming the deliverable tactical seeker head directly without reference to a parallel equivalent optical system. The assembly level to do the focusing operation occurs late in manufacture. At the very least, the large lens and detector housing assembly 915 and 935 is essential, as it is not possible to use the as-molded lens 915 as a separate interchangeable part. The small lens and detector housing do not fit inside the large lens as it came out of the injector blocks.

Figure 11:
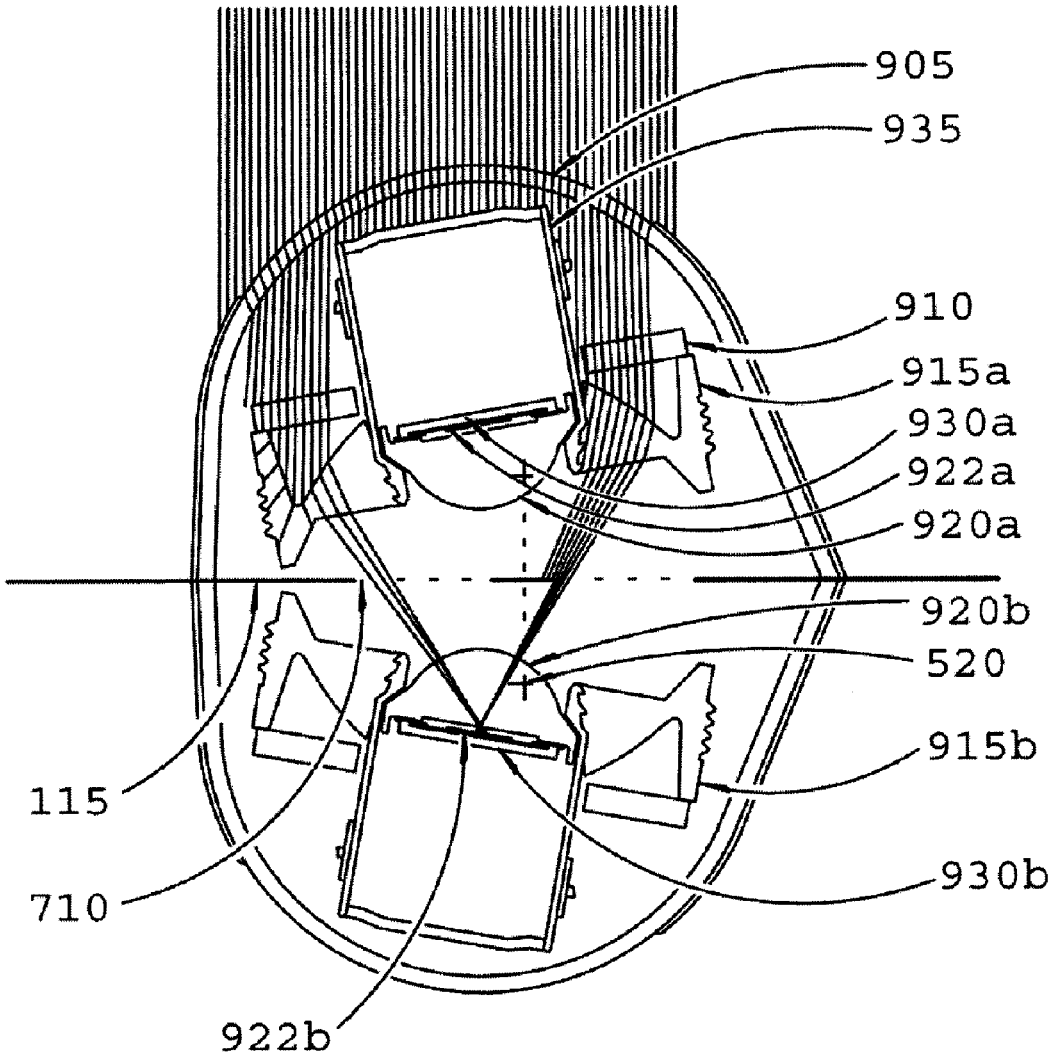
FIG. 11 represents a ray trace of a mirrorless system that is optically equivalent to the system shown in FIG. 10, as well as the mounted clusters of FIG. 8.

FIG. 11 is a through-optical system equivalent to that in the tactical seeker. In fact, FIG. 8, FIG. 10, and FIG. 11 are all optically equivalent. The flat mirror of the original seeker is what enables the use of existing components to substitute for the reflection. The mirrorless system shows two clusters back-to-back or eye-ball-to-eye-ball. It is clear now which components are not in the optical path and may be omitted from the Shim Dialer. The lens cluster 912 should be replicated twice in the Shim Dialer; but it has been determined through experimentation that each of the system's two clusters may often be compromised. They need not have a full complement of components in order to replicate the original seeker optics. Generally, those components that are not in the direct path of the radiation can be omitted, unless required for initial alignment, or support of other active parts, or needed for easy swapping of pieces for sampling.

Direct comparisons of guidance characteristics can be made between the tactical seeker and the Shim Dialer to confirm its fidelity. By virtue of the mirror image design of the Shim Dialer, the secondary optical cluster includes the small piano convex lens 920 with its immersed detector 930. The presence of the detector allows the use of electronic instrumentation to check the focus of the dialer; that is, gain and feedback can be obtained in a manner similar to the formerly established laborious procedures using electronic pen plots.

For feedback, commonly known as optical-gimbal-coupling, a variable resistor or position encoder is attached to the yaw barrel. The collimator is replaced with one that uses a light emitting diode at the tactical wavelength and pulsed at the tactical frequency. The detector outputs go through log-amplifiers, are routed around conventional sample-and-hold circuitry, are summed accordingly, and converted into steady signals. Outputs from the resistor and detector then drive the X-ordinate and Y-abscissa pen plotter. By the time the technician is ready to examine his collection of plots, twenty or so curves have been generated. After sifting through all the sheets, his selections as to where feedback ramps the steepest is determined at last, though purely by eye and of necessity subjective. He then spends a long time manipulating a protractor and punching numbers into a calculator while drawing tangent lines to determine the maximum slopes. When done, feedback for only one focusing shim thickness is recorded. However, he enjoys a little relief albeit small. The technician does not need to keep removing the gyro every time he wants to change the shim as he would on the tactical seeker, but can shim it continuously by turning the shim barrel.

For gain, the technician can loosen the two knob screws 103 and separate the collimator from the dialer section. The collimator is fixed to his bench top. The dialer section is strapped to a rotary table and the yaw barrel set either to zero degrees or some angle of interest, usually less than one degree. Outputs from an encoder on the rotary table and the detector log-amps then drive the pen plotter, resulting in approximately four curves. The technician then spends a long time fussing with pencil and ruler drawing tangent lines to calculate the gain for just this one shim setting. This time, however, his work is slightly easier though small satisfaction. He does not need to remove the gyro over and over again to probe for the best shim, but can merely reset the shim dial instead. Thus, direct comparisons of guidance parameter characteristics can be made between the tactical seeker and the Shim Dialer.

Historically, the dome window 905 and the small piano convex lens 920 have not been a problem. One sample of each of these have been good representations of entire molded lots of thousands. These two items don't require sampling and can be made a permanent part of the dialer. However, the detector electronic device should be treated as follows.

The Shim Dialer becomes a through-optical system when the detector 930*b* and detector housing cover are omitted, as can be concluded from FIG. 11. However, the translucent fiber optic faceplate 922*b* must be included. The translucent screen should be immersed on the piano side of lens 920*b*; that is, bonded there with transparent adhesive. The faceplate should be positioned according to the nominal tactical configuration; that is, the thicknesses of the adhesive and the faceplate should sum to the clearance between the piano surface of the small lens and the silicon face of the detector. The image will be visible on the exiting side of the face plate and be viewable by the microscope. In that way, the conversion of a folded-optical system into a through-optical system is complete.

For folded systems that have a face plate bonded to the detector, but lack the small lens to immerse the faceplate, the faceplate should be bonded to an optically pure glass plate which substitutes for the detector. A plug fixture which fits into the cluster mounts should be used to support the glass and faceplate assembly at the nominal tactical position.

For the secondary cluster, the large piano-convex lens 915*b* would have no effect on the image. However, it is included anyway to support the small lens 920*b*, faceplate 922*b* and empty detector housing 935. The empty cylindrical housing bonded inside the idle lens provides a tunnel to align the bezel for the microscope objective.

Figure 12:
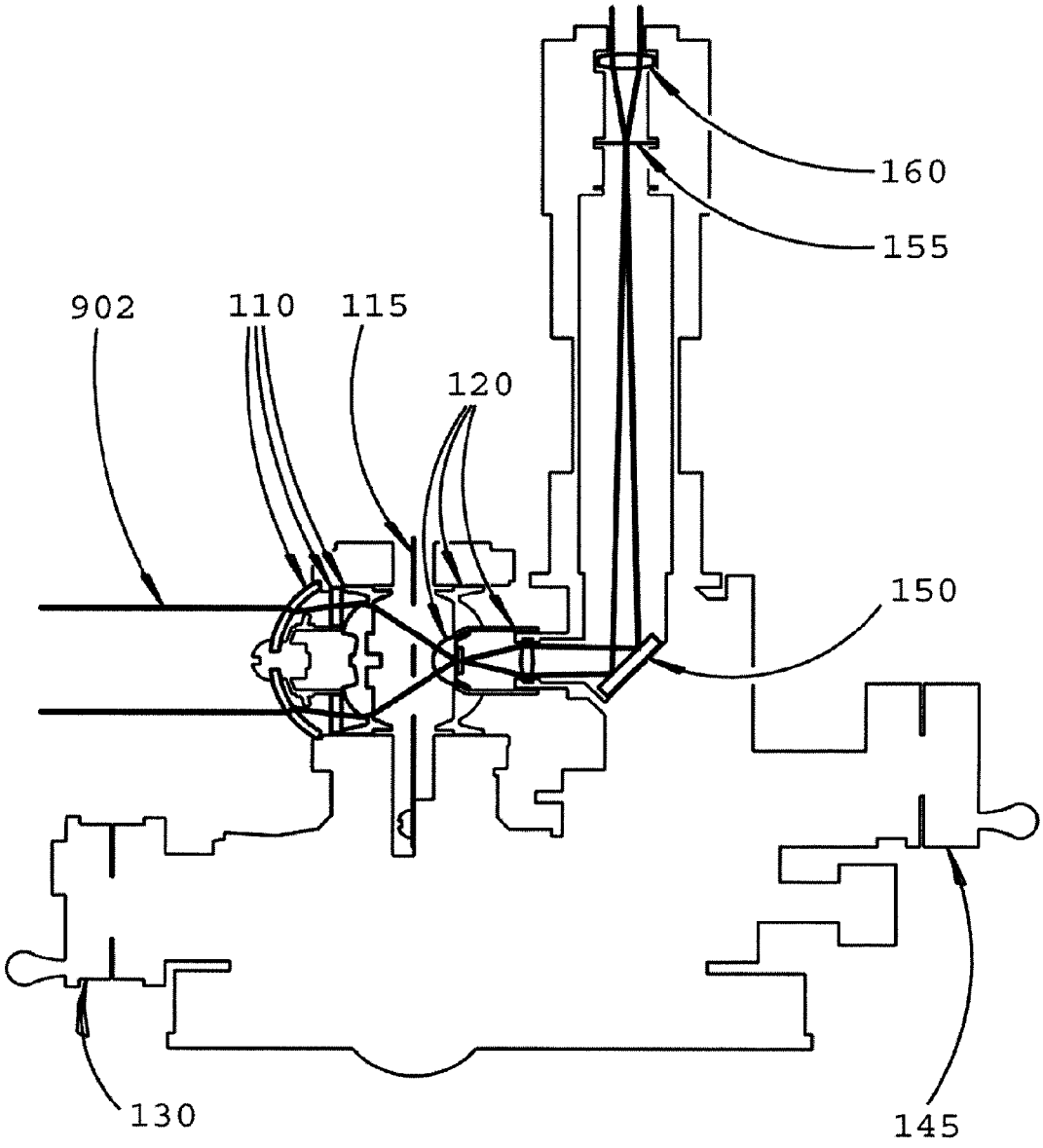
FIG. 12 represents the optical path of the collimated beam traveling through the primary lens cluster, the mask, the secondary lens cluster; the objective of the microscope, the diagonal mirror, and finally the reticule viewed by the eyepiece of a microscope.

FIG. 12 shows the path of the Shim Dialer's through-optical system. Parallel rays 902 blanket a compromised primary cluster 110. The primary cluster is reduced to a sawed-off dome windshield 905 attached to a sawed-off detector housing 935 attached to a blank glass filter 910, all of which can be removed and installed into the dialer as a single assembly. The smaller lens has been omitted from primary cluster 110, along with part of the detector housing normally bonded into the large lens. The large lens 915*a* is inserted into the Shim Dialer as it was molded and annealed; injection stub, gate, parting lines, ejector pin marks and all. The sawed off cluster assembly attaches in front of the large lens to replicate its refraction and masking effects and enable rapid swapping of molded lenses. Characteristics of the large lens are examined without having undergone the costly secondary operations of boring and ultrasonic welding to form the housing assembly. The behavior of the seeker that employs this lens can be predicted long before that seeker is ever glued together. Such an assessment of end item performance at such an early stage in its manufacture is not possible with the tactical configuration.

The molded lens sample transmits light through mask 115, and into the secondary cluster 120. In this cluster the large lens 915*b* and detector housing 935 are mounted as they are welded together, and are used for support of the small lens 920*b*, as in FIG. 11. The cover on the detector housing is removed to allow the microscope objective to penetrate into it. An image is focused on the translucent fiber optic screen 922*b* immersed in the small lens. The microscope includes a diagonal mirror 150 to ease viewing, though this is not essential to function. The image is projected upward onto the reticule 155 which is printed or engraved with a scale or an outline of a gage marking on the detector surface, but at the correct magnification. The magnification implied by the figure is 10×, based on distance to object verses distance to image. The eyepiece 160 and reticule 155 of the microscope are mounted on the microscope tube with a camera lens bayonet fitting and can be broken away and replaced by a commercially available reflex camera. The emulsion focusing plane occupies the previous position of the reticule.

An internal red filter is stationed between light source 102 and collimator lens 105 which approaches the infrared wavelength received by the tactical seeker. The red color approximates the laser designator wavelength but allows the focused image to be visible on conventional black-and-white emulsions. However, optical characteristics like index of refraction, may not be exactly the same for the visible and the infra-red. In that instance, the red filter is removed to allow unfiltered light to pass through the optics, or the lamp replaced by a light-emitting-diode at the tactical wavelength. The clear glass filter 910 is replaced by the tactical filter, complete with blocking and bandpass layers, and the eyepiece is replaced by a video camera utilizing a silicon wafer screen sensitive to infrared. A real-time video of the focused image morphing with yaw is easily viewed on a monitor, and represents the tactical optics with even better fidelity than the simulation with visible light.

In summary, the Shim Dialer creates an optically equivalent apparatus to the original tactical seeker head. The yaw barrel provides angular rotations to simulate pitch and yaw angles induced on the projectile from either lift angle or cross wind. The shim barrel simulates the separation between the gimbaled mirror and the optical cluster controlled by the focusing shim. The image inside the tactical seeker can be viewed while its lens is still in the raw annealed state. Guidance parameters of gain and feedback can be measured electronically on the Shim Dialer and direct comparisons can be made with those values measured electronically on the tactical seeker. The gain and feedback determined by the focusing shim enables the projectile to navigate through the battlefield environment.

The Procedure

A method to operate the optical bench 100 to find a proper shim thickness for the objective lens 915 will be described herein.

Two identical plugs described under FIG. 1 and FIG. 2 above replace the large lens 915 inside the cluster mounts. These gage plugs have threads and shoulders identical to the molded lens. The plugs have flat faces and center probes that protrude out an equal distance from the lens shoulders in the mount cavities. Thus these centers and flats align themselves to the true position of the lens shoulder.

To summarize the procedure, it begins with determining the zero position of the yaw barrel. Then the mounts are set normal to the ways. Then the mask is centered along the trolley pins. Then the axes of the mounts and the center of the mask are made to coincide when the yaw barrel is zeroed. During this step, the mounts are set equally distant from the mask. Finally, the collimator is aligned to project symmetrical images when viewed through the eyepiece.

Align the cluster mounts so they are parallel as follows. Rotate the shim dial 130 clockwise and move the two way platform slides on 140 apart. Unfasten two right angle cross plates, one of which is clearly visible in FIG. 1. Remove only the two lower screws on each of the two right-angled plates and remove both cluster mounts with their angle-irons still attached to them. Remove the bridge and mask assembly 115. This will expose yet two more cross plates with ridge block protrusions where the angled cross plates were engaged. The exposed ridges are at right angles to the dove-tail ways. Place a rectangularly squared plate between the ridge protrusions. Bring the platforms against the gage plate by turning the dial counter clockwise, so that the squared ridges contact the plate and barely confine it. Slide the plate along the ridges to check their parallelism while adjusting the yaw barrel. When satisfied that the cross-plates are parallel, rock the yaw barrel about its end-play and pencil mark the mid-point of the play representing zero yaw. Remove the gage plate.

Set the mounts vertical with a square as follows. Install the primary cluster mount over its cross plate. Insert a gage plug into it. Loosen the set screw that tilts the mount on a horizontal axis which is at a right angle to the dovetail ways. Place a square on the secondary cross plate which is still exposed. It should square up with the face of the gage plug. Ideally, the target feature on the mount should be the shoulder for the large lens. Adjust and tighten the cluster mount to be vertical to the ways. Remove the primary mount and install the secondary over its cross plate. Insert the other gage plug into the secondary. Repeat to get the second mount vertical. Leave the secondary mount on and the primary off.

Align the bridge and mask. Each dovetail way is indexed to its clevis with grooves and pins, specifically surface 330. Likewise, the bridge is also indexed to the trolley and always bolts onto it in a unique position. Back away the dovetail way slides as far as they will go by rotating the shim barrel clockwise. Remove the four screws that attach the primary way 140*a* to its clevis. Slide the primary way away from the secondary way 140*b* and out of its half of the keyway 133 while manually supporting the universal joint 132. Place the primary way aside being careful not to disturb the dial setting. Slide the universal joint free of the remaining half of keyway 133 and place it aside. Screw the bridge and mask assembly onto the trolley plate. The center axis of the mask will go through the center of the button for the tactical seeker example given in the above discussions. The trolley should also be engraved with the mid line joining the two clevis pins, as described in the discussion of FIG. 5 above. A small hole in the center of the mask button should be directly above this mark as verified by a square. The thin mask plate has oversized holes where it attaches to the bridge. Place a square on the trolley and tighten the mask against the bridge so that its button is centered over the trolley; that is, it aligns directly above the engraved line joining the clevis pins. Adjust the height of the mask so that its center is about the same height as the center of the secondary mount. Tighten the screws which fasten the mask to the bridge to maintain that centered position.

Replace the primary dovetail way. Slide the universal joint under the bridge and back onto the keyway of the secondary dovetail way. Support the universal joint and slide the primary dovetail way toward the secondary and reconnect its keyway into its half of the slip joint. Replace the four screws in the clevis. With a plug still fixed inside the secondary cluster mount, crank the plug toward the mask with the shim dial 130 until it touches the mask. Loosen the cross plate position set screws on the secondary cluster mount. Adjust the cross-plates that fix the vertical and horizontal positions that are at right angles to the way direction. Tighten the vertical and horizontal positions to center the probe on the center of the mask. Back off the secondary cluster mount from the mask by one or two clockwise turns of the dial. Now install the primary cluster mount and insert its gage plug. Loosen the cross plates for fixing the horizontal position parallel to the way direction for both mounts. Fix them where they both contact the mask simultaneously when approached by slowly cranking the dial counter-clockwise. If cross plate latitude is insufficient to make them both reach the mask simultaneously, then one way must be indexed to a different thread position. In that event, remove the four screws going into the clevis from the primary dovetail way which index it to clevis surface 330. Slide the way with its mount attached back while supporting the universal joint 132, and disconnect the way assembly from the slip joint 133. Rotate the secondary way screw using the knob 131 the appropriate number of complete turns, slide the primary way toward the other again, reconnect the universal joint keyway and replace the four screws. Keep repeating the removal and installation of the primary way until both probes contact the mask simultaneously. Once both probes are in contact with the mask, center the primary contacting probe to center on the mask. Remove the mask and bridge assembly by removing two screws on the trolley and check if the probe centers contact each other.

Check the zeroing of the yaw barrel by optical means. Remove both gage plugs and replace them with optical clusters shown in FIG. 12. Assemble the microscope and collimator and adjust them until the reticule is illuminated. In order to do this, start with the shim dial set a little greater than the approximate nominal shim thickness where the tactical optics should be functional. Slowly bring the clusters together while tilting the collimator until some light is visible. The spot image at zero yaw should be centered on the reticule. If it is not, adjust the collimator position and angles. Bring the image to the sharpest possible focus. The surface of the screen or fiber optic faceplate should be in focus on the reticule. In the case of the tactical faceplate example given here, the hexagonal array of fiber optic filaments should be apparent. Back off the shim dial until a halo appears. It is permissible to remove the windshield to view a clearer image. The ring of light should be symmetrical. Determine if any asymmetry in the halo is due to the cluster or due to misalignment of the apparatus. Rotate the forward or primary cluster on its lens axis to observe if the asymmetry follows the cluster and is only a characteristic the seeker optics. If asymmetrical features of the halo remain fixed, it means that the apparatus must be realigned.

Attach the bridge and mask assembly, replace the windshield, and bring the image to the most concentrated spot possible with the shim dial. Crank the yaw barrels and observe the spot change shape into a comet. Adjust the dial to reveal distinguishing features of the image, such as sharp points or bright spots. These features will be most useful in determining shim thicknesses.

Following alignment of the dialer, it should be calibrated. Dimensions taken from the tactical seeker assembly configuration are used. These are referred to as the "nominal." The piano faces of two clusters are first separated by the nominal expected for good guidance. Following that, the dial is set at the nominal shim thickness.

Remove the mask and bridge assembly and insert two complete lens clusters into each cluster mount. Set a telescoping gage to twice the nominal distance from the piano surface of lens 915 to the mirror 925 at zero yaw FIG. 9. Close the two cluster piano surfaces against the gage using the shim dial. Loosen the zero knob on the dial and set it at the nominal shim thickness. Remove the clusters, install the gage plugs and mask. Check their alignment again as in step 4. Remove the gage plugs. Reinstall the mask and bridge assembly.

This favorite lens is often considered to be the standard, associated with a "shop queen." A reduced cluster should be inserted into the secondary mount which includes the a large lens 915*b* welded to the detector housing 935, a small lens 920*b* shown in FIG. 11, and the immersed fiber optic faceplate 922*b* bonded into the small lens shown in FIG. 12. Set the shim dial at the nominal and study the spot image morph over the entire yaw range. This is the image that forms inside the tactical seeker. The light patterns across the epitaxial boundaries of the detector comprise a critical transfer function of the guidance system loop.

At this point, gain and feedback can be measured electronically according to the description of FIG. 11 given above. Gain and feedback plots should agree with those sampled from lenses in seekers, as tested by the old laborious method of seeker head verification. Lenses may vary in focal characteristics, but all will project a similar spot image when each is assembled with its optimum shim. This fact has been verified through optical ray trace computation, as well as years of experience with thousands of lenses that were optically scanned and assembled into deliverable seekers. Lenses molded by a certified process and dimensionally correct, but do not form images close to that of a standard are not usable regardless of the shim setting. The Shim Dialer provides a method for isolating these defectives.

The Shim Dialer can now be used to determine the optimum shim thickness for a particular lens.

During operation of the optical bench 100, the large objective lens 915 under test, as molded and annealed, is screwed or snapped into the primary optical cluster 110 mount. The reduced optical cluster, which includes a sawed off dome windshield 905 and filter glass 910, is placed over the lens 915 to closely approximate the projectile nose optics. The technician zeros the yaw barrels and looks through the microscope while turning the shim dial. The spot is first brought to the sharpest and most concentrated focus. He or she then rotates the yaw barrel and observes the morphing or changing shape of the spot image. Through experience gathered from comparison of spot images with results from electronic instrumentation of the photo detector, the optimum shapes of the spot that give the best guidance characteristics are well known. He adjusts the shim dial until he judges that the optimum spot image for good guidance has been reached. That dimension is recorded and associated with the lens under test. In a parallel assembly line, the height of the gyro; that is, the distance from its shoulder to its mirror surface, is gauged. The depth of the gyro cavity in the seeker housing, as well as torquing allowances are also significant. The arithmetic sums of these parameters determines the selection of the best shim.

All the drawings are illustrative in nature and do not depict the actual size or scale of the objects shown. It is to be understood that the specific embodiments of the invention that have been described are merely illustrative of certain applications of the principle of the present invention. Numerous modifications may be made to a system and method to view the optical image of folded optics including a diagonal mirror or change in spline spacing or single journal universal joint as mentioned herein, without departing from the spirit and scope of the present invention.

What is claimed is:

1. An optical bench for viewing an image of folded optics, comprising:

a light source and a collimator to generate a collimated beam;

a primary optical cluster of the folded optics for the collimated beam to enter;

a secondary optical cluster that is optically equivalent to a mirror and subsequent stages of the folded optics in a mirror image, to form an optical image linearly downstream of the primary optical cluster; and a measurement instrument to view the formed optical image, wherein the primary optical cluster comprises:

an optical filter;

a first objective lens for converging the collimated beam; and a reduced optical cluster comprising a second objective lens and a photo detector.

2. The optical bench of claim 1, wherein the first and second objective lenses are shock resistant plastic comprising polycarbonate.

3. An optical bench for viewing an image of folded optics, comprising:

a light source and a collimator to generate a collimated beam;

a primary optical cluster of the folded optics for the collimated beam to enter;

a secondary optical cluster that is optically equivalent to a mirror and subsequent stages of the folded optics in a mirror image, to form an optical image linearly downstream of the primary optical cluster; and a measurement instrument to view the formed optical image, wherein the optical cluster is secured to a reversing transmission rack system, and comprises:

a threaded shaft having ends that are connected to a rack, and is driven by a yaw barrel;

a block with a central threaded hole mated to the threaded shaft;

two sets of collinear bosses, each set projecting on both sides of the block;

a pair of clevis each connected to bosses on both sides of the block, remotely from the shaft;

wherein the pair of clevis comprises:

splines that co-act with matching splines on plane surfaces of the rack system; and a primary dovetail way and a secondary dovetail way respectively mounted on the pair of clevis;

wherein a set of the collinear bosses acts as a pivot for a clevis.

4. The optical bench of claim 3, wherein the yaw barrel turns the shaft to induce yaw angles in the pair of clevis, which induces yaw angles in the optical clusters mounted on the pair of clevis in the reversing transmission rack system.

5. The optical bench of claim 4, wherein the splines constrain an angulation to the displacement.

6. The optical clusters of claim 3, further comprise a mask midway between the two sets of bosses.

7. The optical clusters of claim 6, wherein a spacing is interposed between centers of the two sets of bosses on the block; and wherein the spacing is double the distance from a gyro gimbal center to a surface of the mirror.

8. The optical bench of claim 3, wherein the primary dovetail way is driven by a shim dial, and wherein the secondary dovetail way is driven by a dial barrel.

9. The optical bench of claim 8, wherein the shim dial yields a shim thickness for the collimated beam to focus in the folded optics.

10. The optical bench of claim 9, further comprising a zero setting on the shim dial that assigns a dimensional value to any position of the platforms.

11. The optical bench of claim 3, wherein a universal joint has slip joints at each end connected to two dovetail ways, which allows the two dovetail ways to move closer together or farther apart with yaw.

12. An optical bench for viewing an image of folded optics, comprising:

a light source and a collimator to generate a collimated beam;

a primary optical cluster of the folded optics for the collimated beam to enter;

a secondary optical cluster that is optically equivalent to a mirror and subsequent stages of the folded optics in a mirror image, to form an optical image linearly downstream of the primary optical cluster; and a measurement instrument to view the formed optical image, wherein the optically equivalent apparatus comprises:

a mask with at least one aperture to allow the collimated beam to pass through;

a second objective lens downstream from the first objective lens where the collimated beam enters; and a translucent screen behind the second objective for the beam to focus.

13. The optical bench of claim 12, wherein the measurement instrument comprises:

an objective lens to focus on the image on the translucent screen behind the second objective lens in the optically equivalent apparatus on the optical bench;

a focus barrel attached to the measurement instrument to focus the eyepiece onto the image on the translucent screen;

a reticule disposed behind the second objective lens in the optically equivalent apparatus for viewing the image; and an eyepiece to view the image.

14. The optical bench of claim 13, wherein a diagonal mirror turns the beam path prior to the reticule.

* * * * *